US009048579B2

(12) United States Patent
Itou et al.

(10) Patent No.: US 9,048,579 B2
(45) Date of Patent: Jun. 2, 2015

(54) LEVER-TYPE CONNECTOR

(71) Applicant: Sumitomo Wiring Systems, Ltd., Yokkaichi-City, Mie (JP)

(72) Inventors: Masatoshi Itou, Yokkaichi (JP); Takao Hata, Yokkaichi (JP); Tomohiko Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 4 days.

(21) Appl. No.: 14/073,360

(22) Filed: Nov. 6, 2013

(65) Prior Publication Data

US 2014/0134862 A1 May 15, 2014

(30) Foreign Application Priority Data

Nov. 13, 2012 (JP) ..... 2012-249197

(51) Int. Cl.
*H01R 13/62* (2006.01)
*H01R 13/629* (2006.01)
*H01R 13/516* (2006.01)

(52) U.S. Cl.
CPC ..... *H01R 13/62944* (2013.01); *H01R 13/516* (2013.01); *H01R 13/62955* (2013.01); *H01R 13/62977* (2013.01)

(58) Field of Classification Search
USPC ..... 439/157, 372
See application file for complete search history.

(56) References Cited

U.S. PATENT DOCUMENTS

| | | | | |
|---|---|---|---|---|
| 5,681,175 | A * | 10/1997 | Busse et al. | 439/157 |
| 6,168,445 | B1 * | 1/2001 | Seutschniker et al. | 439/157 |
| 6,213,795 | B1 * | 4/2001 | Drescher et al. | 439/157 |
| 6,361,356 | B1 * | 3/2002 | Heberlein et al. | 439/489 |
| 8,215,970 | B2 * | 7/2012 | Shamoto et al. | 439/157 |
| 8,246,365 | B2 | 8/2012 | Shishikura et al. | |
| 2010/0323537 | A1 * | 12/2010 | Vasbinder et al. | 439/65 |

* cited by examiner

*Primary Examiner* — Tho D Ta
*Assistant Examiner* — Travis Chambers
(74) *Attorney, Agent, or Firm* — Gerald E. Hespos; Michael J. Porco; Matthew T. Hespos

(57) ABSTRACT

A lever (4) mounted on a cover (3) is held at a standby position and, in that state, the cover (3) is fitted to a housing (1) in a connecting direction to a position where the cover (3) is not aligned with the housing (1). At this position, gear teeth of the lever (4) and rack teeth of sliders (2) do not interfere with each other and are not engaged. If the cover (3) is subsequently moved in a direction perpendicular to the connecting direction via a guiding action of the engagement of guide receiving portions (9) of the connector housing (1) and U-shaped guide portions (15) formed on the cover (3), the cover (3) is smoothly mounted at a proper mounting position. At this time, since the guide portions (15) vertically sandwich the guide receiving portions (9), upward detachment of the cover (3) is prevented.

8 Claims, 15 Drawing Sheets

LEVER-TYPE CONNECTOR

BACKGROUND

1. Field of the Invention.

The invention relates to a lever-type connector.

2. Description of the Related Art.

U.S. Pat. No. 8,246,365 discloses a connector having a force multiplying function by a lever and a slider. The slider is provided in a housing of the connector and movable in directions perpendicular to a connecting direction to a mating connector. Further, a cover for accommodating wires drawn out from the housing is mounted on the housing and the lever is rotatably mounted on the cover. The lever is formed with a gear and the slider is formed with a rack engageable with the gear. Further, the slider is formed with a cam groove for guiding a cam pin provided on the mating connector.

If the lever is rotated in a state where the two connectors are lightly fitted, the slider moves via the engagement between the gear and rack and the cam pin is guided by the cam groove, whereby the two connectors are connected.

The above cover is mounted by being fitted onto the connector housing from above and engaging a plurality of resilient pieces provided on the cover with the connector housing. However, if there is a relative displacement between the slider and the lever when the cover is mounted, it leads to a problem that the gear of the lever and the rack of the slider are not smoothly engaged and the cover cannot be easily mounted due to interference. Further, since a holding force of the cover depends on resilient forces of the resilient pieces, the above structure has sufficient room for improvement in terms of improving the holding force.

The invention was completed in view of the above situation and aims to enable a cover to be smoothly mounted and can improve a holding force of the cover.

SUMMARY OF THE INVENTION

The invention relates to a lever-type connector for connecting connectors by rotating a lever. The connector includes a housing formed with a cavity for accommodating a terminal fitting and connectable to a mating connector. A cover is mounted on a surface of the housing substantially opposite to a connection surface and is configured to at least partly cover a wire drawn out from the housing. A lever is mounted rotatably on the cover and formed with gear teeth on an edge part around a center of rotation of the lever. A slider is accommodated in the housing displaceably in a direction intersecting a connecting direction and is formed with rack teeth engageable with the gear teeth at a position substantially facing the lever and a cam groove for guiding a cam pin provided on the mating connector to bring the connectors into a connected state. The cover includes a guide and the connector housing includes the guide receiving portion. The guide and the guide receiving portion extend in the direction intersecting the connecting direction. The guide and the guide receiving portion engage with each other after or when the cover is mounted in a direction along the connecting direction to a non-engageable position where the cover is not aligned with the housing and the gear teeth and the rack teeth are not engaged and guide a movement of the cover along the direction intersecting the connecting direction to an engageable position where the cover is aligned with the housing and the gear teeth and the rack teeth are engageable. The guide is undeflectably formed on the cover, the guide receiving portion is undeflectably formed on the housing, and/or the guide and the guide receiving portion include parts that come into contact with each other in the connecting direction, thereby preventing the cover from being detached in the connecting direction.

The lever-type connector may be configured so that the lever is held at a standby position where the gear teeth are located at such a height position as not to interfere with the rack teeth and the slider is held at a first position spaced apart forward from the cover in a moving direction of the cover in a slider accommodating chamber formed in the housing when the cover moves from the non-engageable position to the engageable position.

The lever preferably is formed with a stopper tooth for preventing the slider from moving in a direction opposite to the moving direction of the cover by coming into contact with the leading rack tooth substantially facing in the moving direction of the cover out of the rack teeth of the slider at the first position in a state where the cover is at the engageable position and the lever is at the standby position. Thus, even if an external force should be applied to the slider when the slider is at the first position, a situation where the slider is inadvertently moved in a direction opposite to the moving direction of the cover can be avoided.

A stopper tooth may be arranged at an end part in an arrangement direction of the gear teeth and a pitch between the stopper tooth and the gear tooth adjacent to the stopper tooth may be set to be larger than a pitch between the other gear teeth. Thus, interference with the rack teeth of the slider can be more reliably avoided when the cover is mounted in the unaligned state on the housing.

The slider may be accommodated so as not to project out from the slider accommodating chamber at the first position. Thus, the slider is unlikely to be subjected to an external force and a situation where the slider is damaged or deformed by an external matter can also be avoided.

The lever may be rotatable or pivotable (i.e. displaceable) between the standby position which is one engagement stroke end of the gear teeth and the rack teeth and an initial position which is the other engagement stroke end and/or the slider may be movable between the first position and a second position as the gear teeth and the rack teeth are engaged.

The cam groove of the slider may be capable of receiving the cam pin formed on the mating connector when the slider is at the second position.

A temporary holding means for releasably temporarily holding the slider at the second position may be provided at least between the slider and the connector housing or between the lever and the cover. Thus, the slider is held at the second position by the temporary holding means provided at least between the slider and the connector housing or between the lever and the cover. Thus, the cam pin can be smoothly guided to the entrance of the cam groove at the time of connecting the connector housing.

These and other objects, features and advantages of the invention will become more apparent upon reading the following detailed description of preferred embodiments and accompanying drawings.

DETAILED DESCRIPTION OF THE PREFERRED EMBODIMENTS

The lever-type connector of this embodiment is provided with a female housing 1, sliders 2 movably mounted on the housing 1, a cover 3 for covering wires W drawn out from the housing 1, and a lever 4 rotatably mounted on the cover 3.

Note that, in the following description, terms relating to "upper and lower sides" and "left and right sides" are based on FIG. 1.

Figure 2:
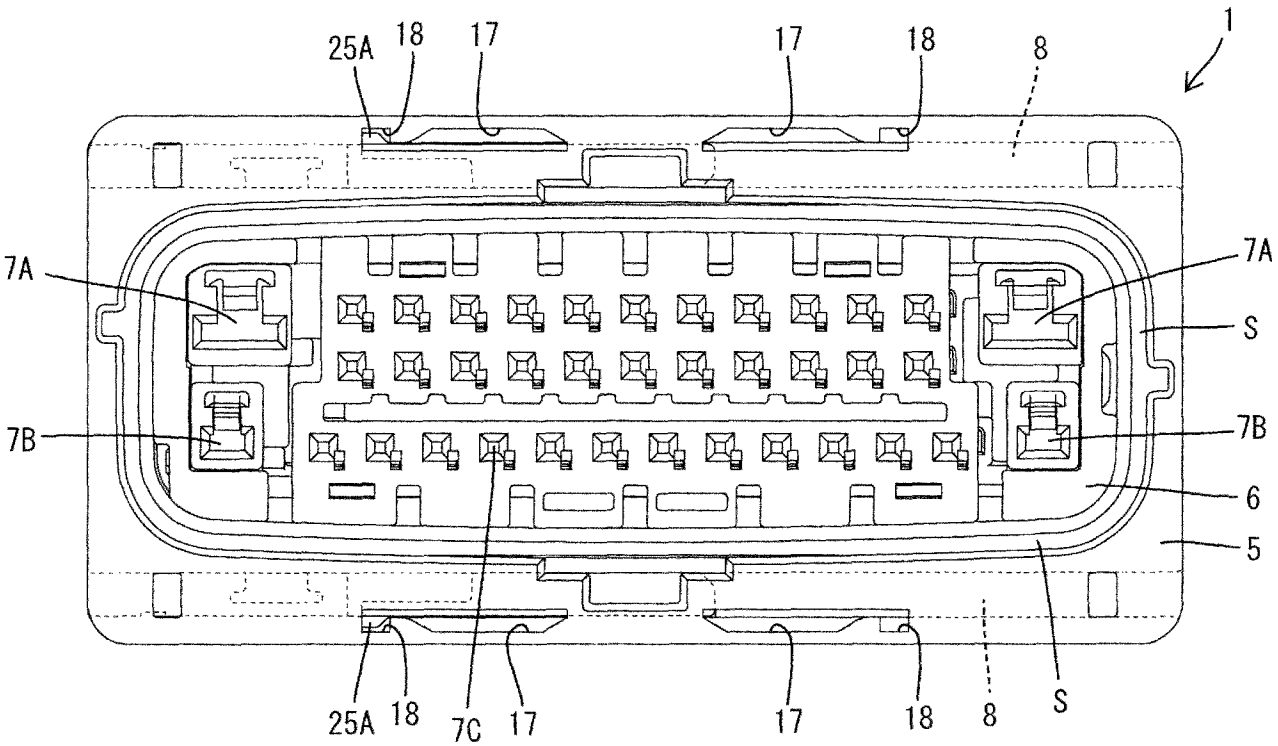
FIG. 2 is a view of a connector housing when viewed from a connection surface side.
Figure 3:
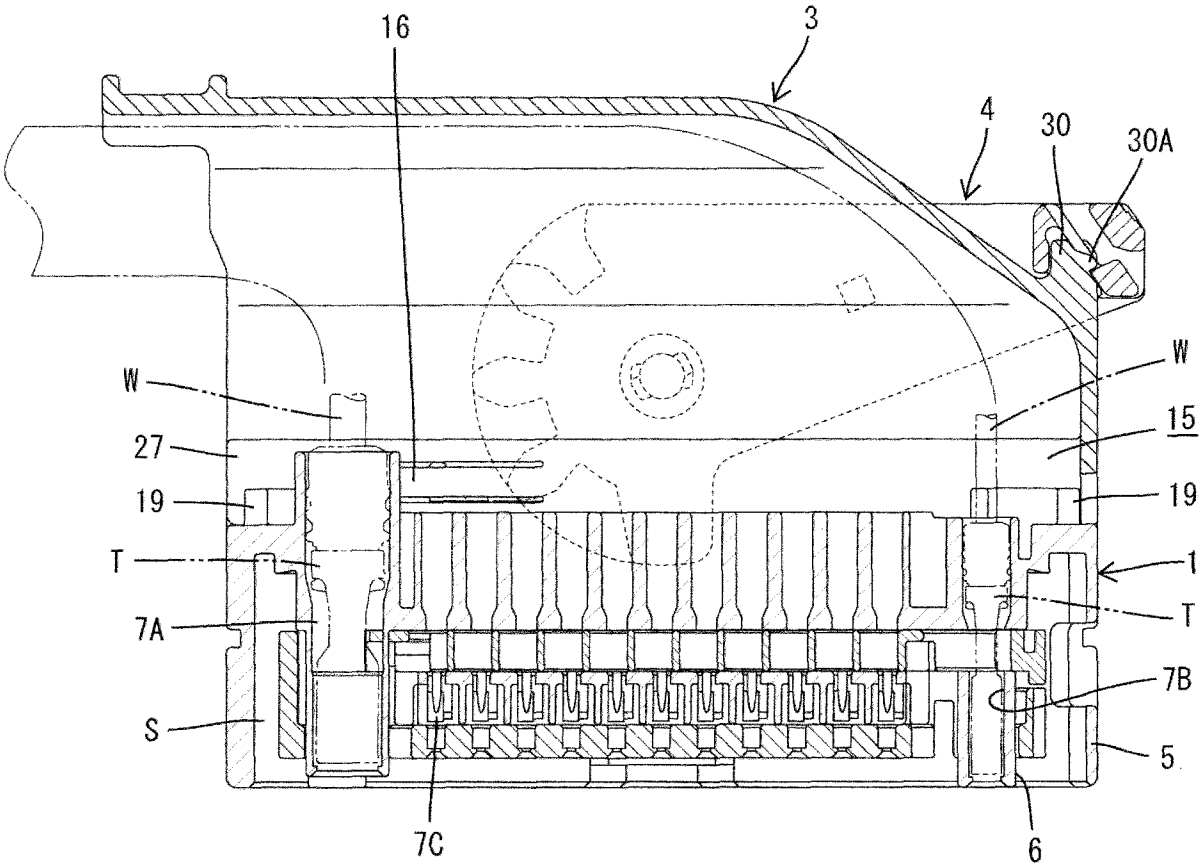
FIG. 3 is a side view in section of the lever-type connector.

The housing 1 is made of synthetic resin and, as shown in FIG. 2, has a rectangular outer tube 5 and an inner tube 6 at least partly in the outer tube 5. A connection space S is formed around the inner tube 6 and between the tubes 5, 6 for receiving a mating connector. As shown in FIGS. 2 and 3, cavities 7A to 7C are formed in the inner tube 6 for accommodating terminal fittings T. The cavities 7A to 7C are open vertically in connecting directions. The terminal fittings T are insertable from above and mating terminal fittings in the mating male connector M are insertable from below.

The cavities 7A to 7C have different sizes. As shown in FIG. 2, large and middle-size cavities 7A, 7B are arranged vertically one above the other at opposite ends of longer sides of the housing 1, and small cavities 7C for accommodating small terminal fittings T are arranged in an area between the large and middle-size cavities 7A, 7B.

Figure 4:
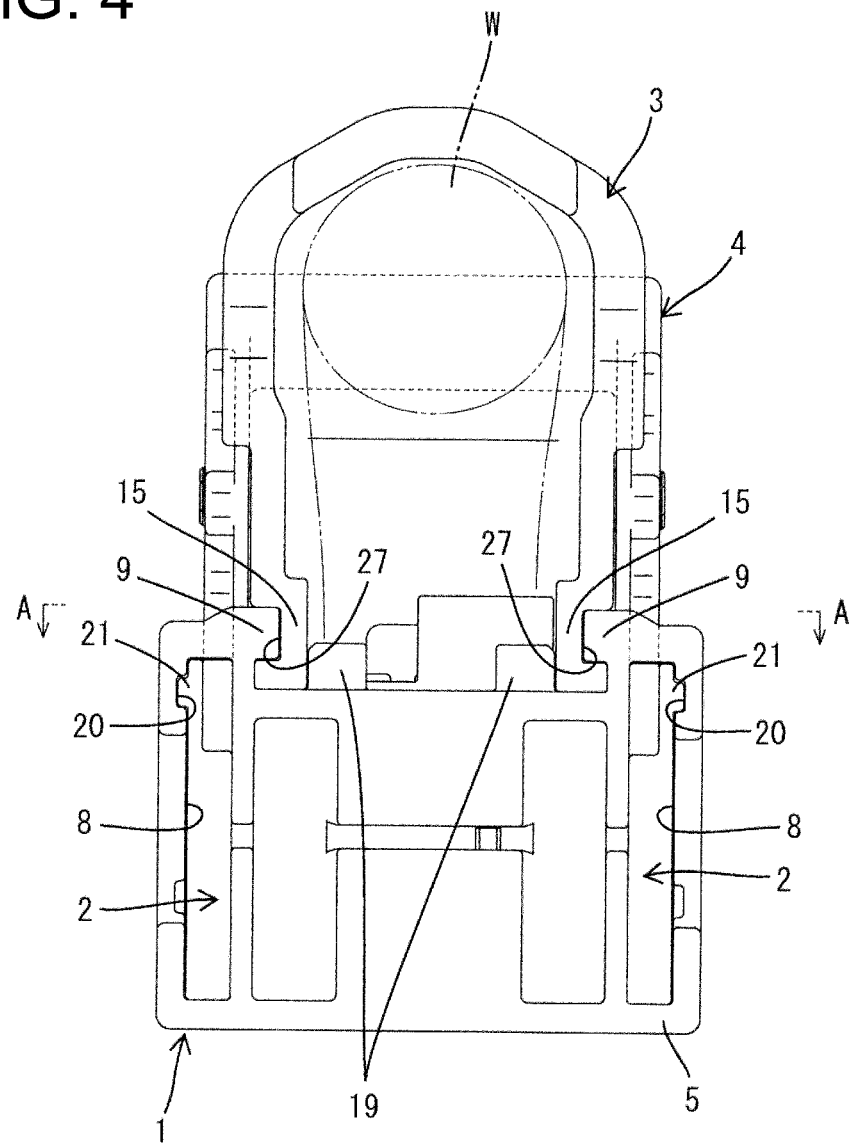
FIG. 4 is a bottom view of the lever-type connector.

As shown in FIG. 4, both longer sides of the outer tube 5 are hollow structures composed of inner and outer walls. These hollow parts define slide accommodating chambers 8 for accommodating the sliders 2. As shown in FIG. 4, upper edges of wall surfaces of both slider accommodating chambers 8 project to be located farther up than the upper surface of the inner tube 6. Two guide receiving portions 9 protrude substantially in horizontal directions in FIG. 4 and face each other on the inner wall surfaces of these projecting parts. The guide receiving portions 9 extend laterally of the housing 1.

Figure 5:
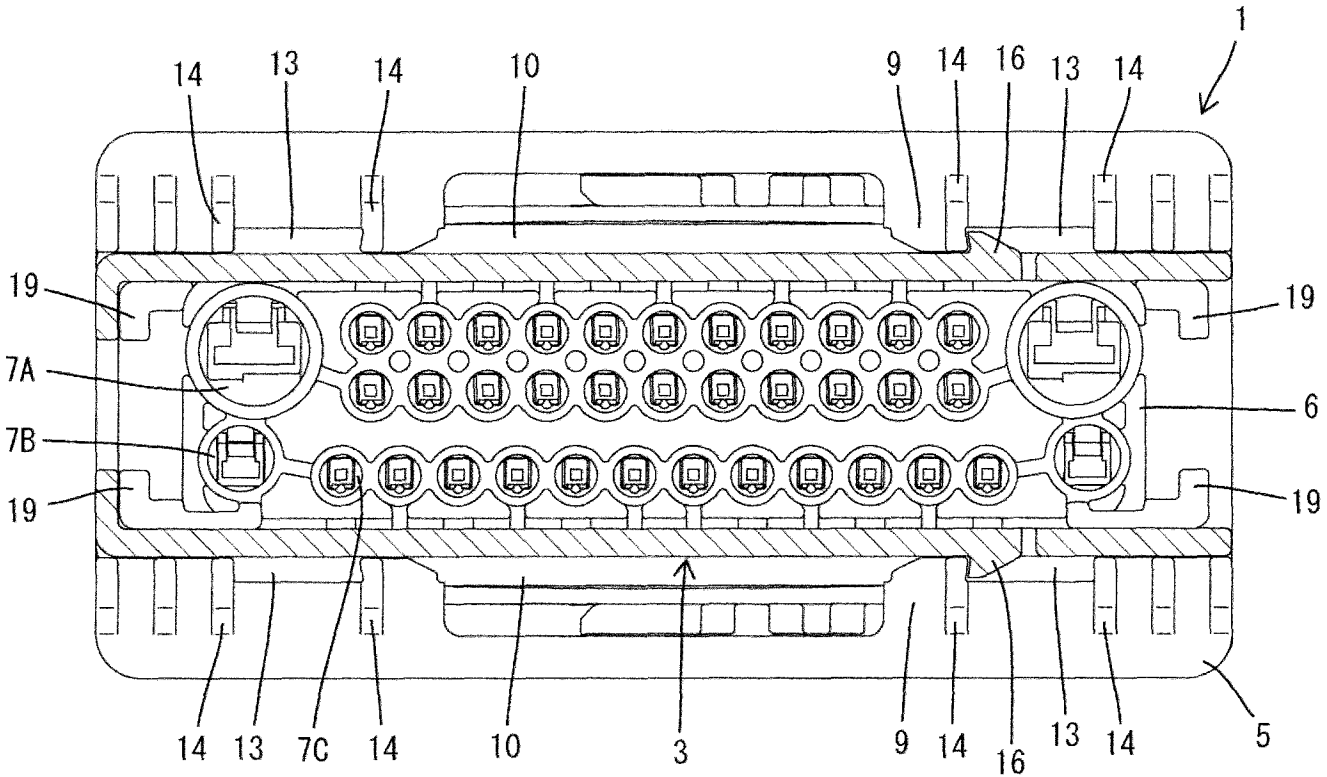
FIG. 5 is a section along A-A of FIG. 4.
Figure 8:
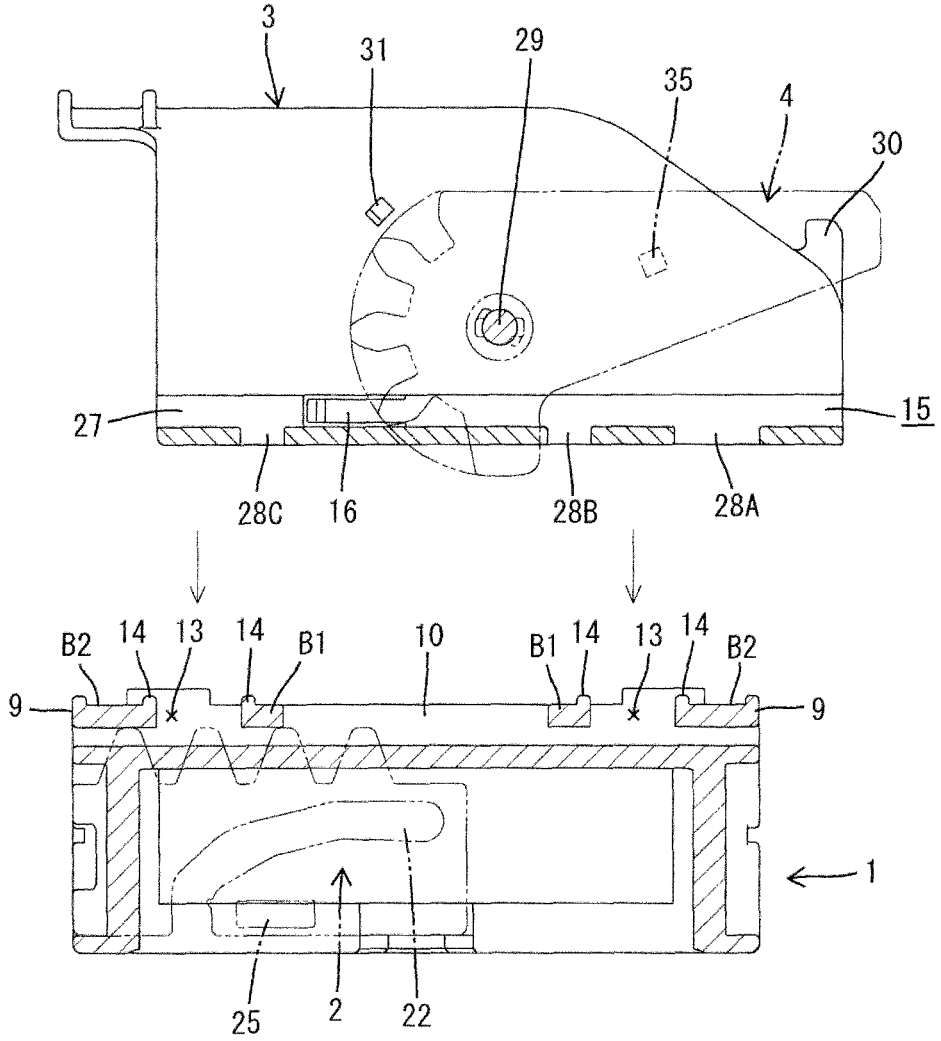
FIG. 8 is a side view in section showing a state where a cover and a connector housing are separated in a cover mounting procedure.
Figure 13:
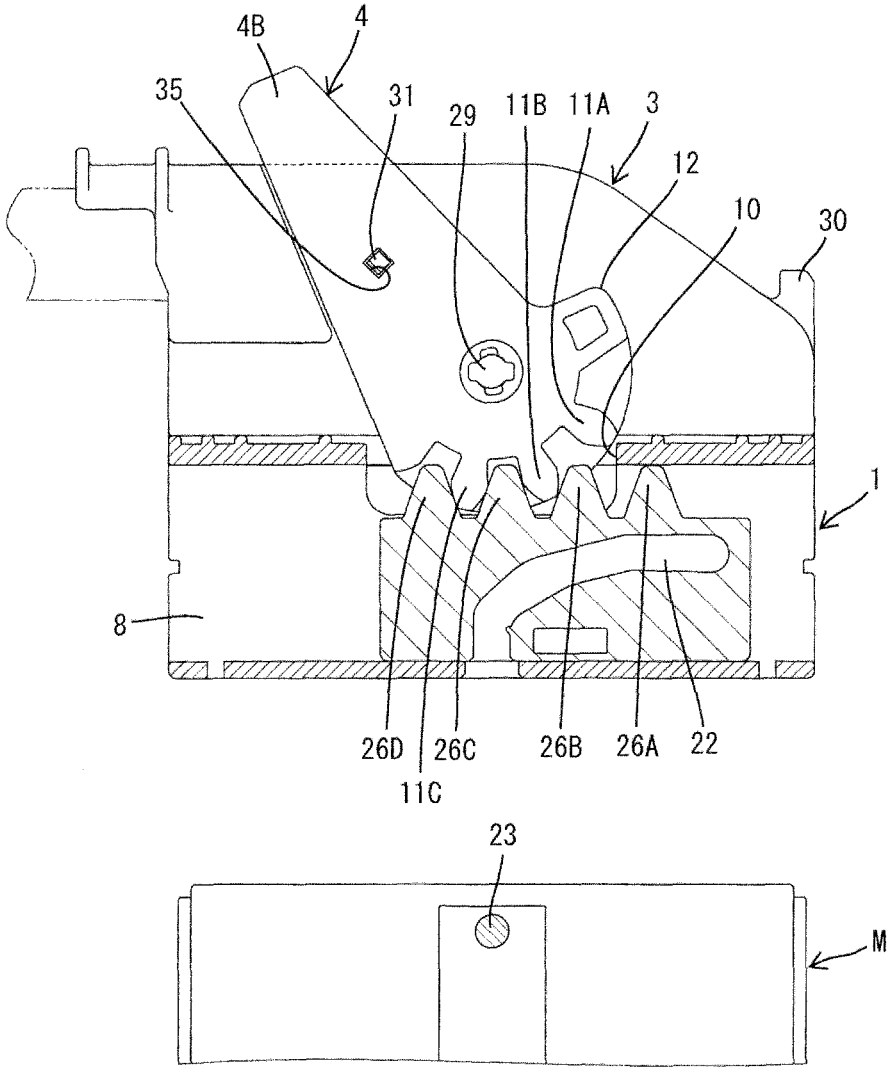
FIG. 13 is a side view in section showing a state before connectors are connected in a connector connecting procedure.

As shown in FIGS. 5, 13, etc., a cut 10 is formed in a lateral central part of each guide receiving portion 9 substantially over the entire range in a protruding direction and over a specified width. Each guide receiving portion 9 has two escaping portions 13 at positions adjacent to the cut 10 and substantially bilaterally symmetrical with respect to the cut 10. The escaping portions 13 are shorter than the cut portion 10 in a longitudinal direction and, as shown in FIGS. 5 and 8 two projecting edges 14 project up on left and right opening edges of each escaping portion 13. The escaping portions 13 function to avoid interference with a guide 15 of the cover 3 when the cover 3 is mounted in an unaligned state on the housing 1 and allow a mounting piece 16 of the cover 3 to engage the opening edge of the escaping portion 13 and the projecting edge 14 (see FIG. 5). The escaping portions 13 are at the laterally symmetrical positions to enable the cover 3 to be mounted on the housing 1 either in a left-facing posture or in a right-facing posture.

Figure 11:
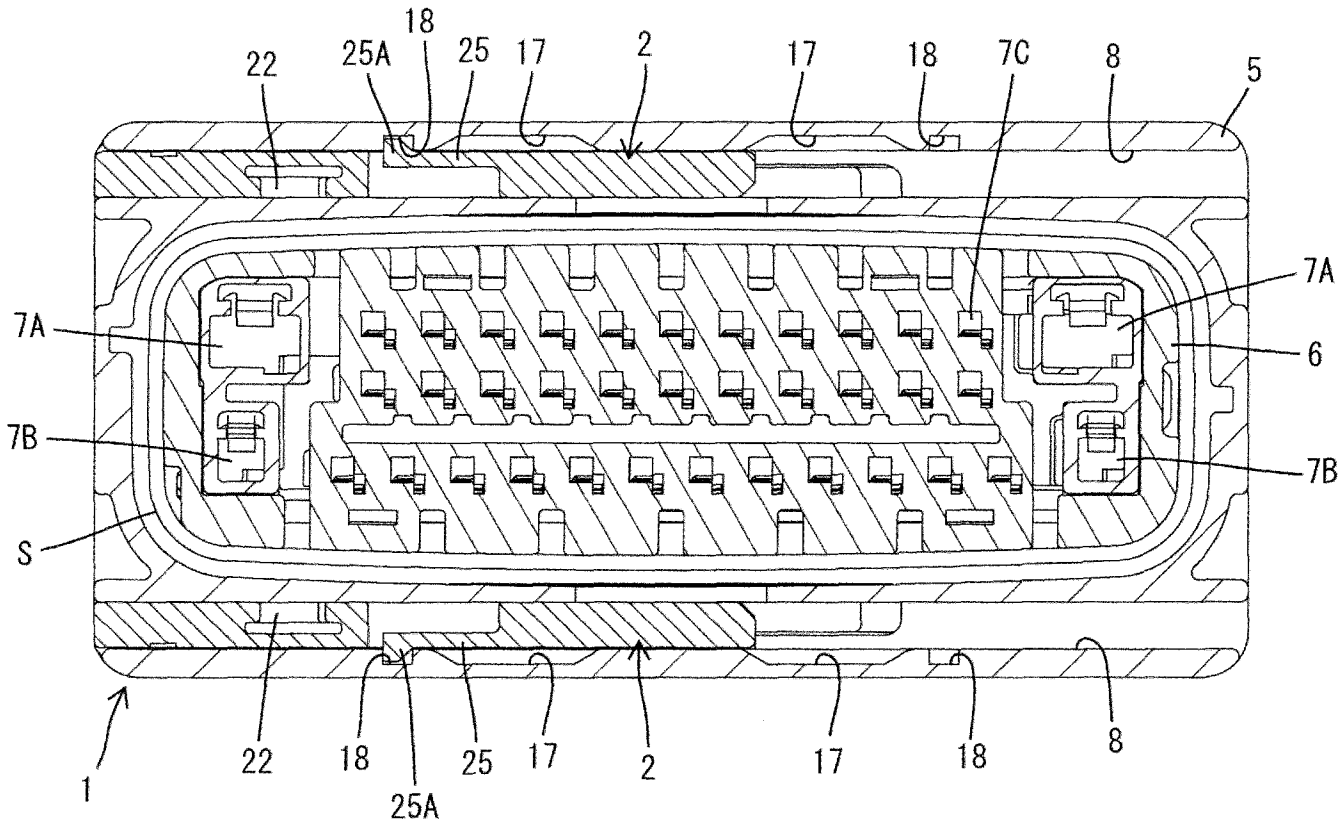
FIG. 11 is a front view in section showing a state where the sliders are at a first position.
Figure 12:
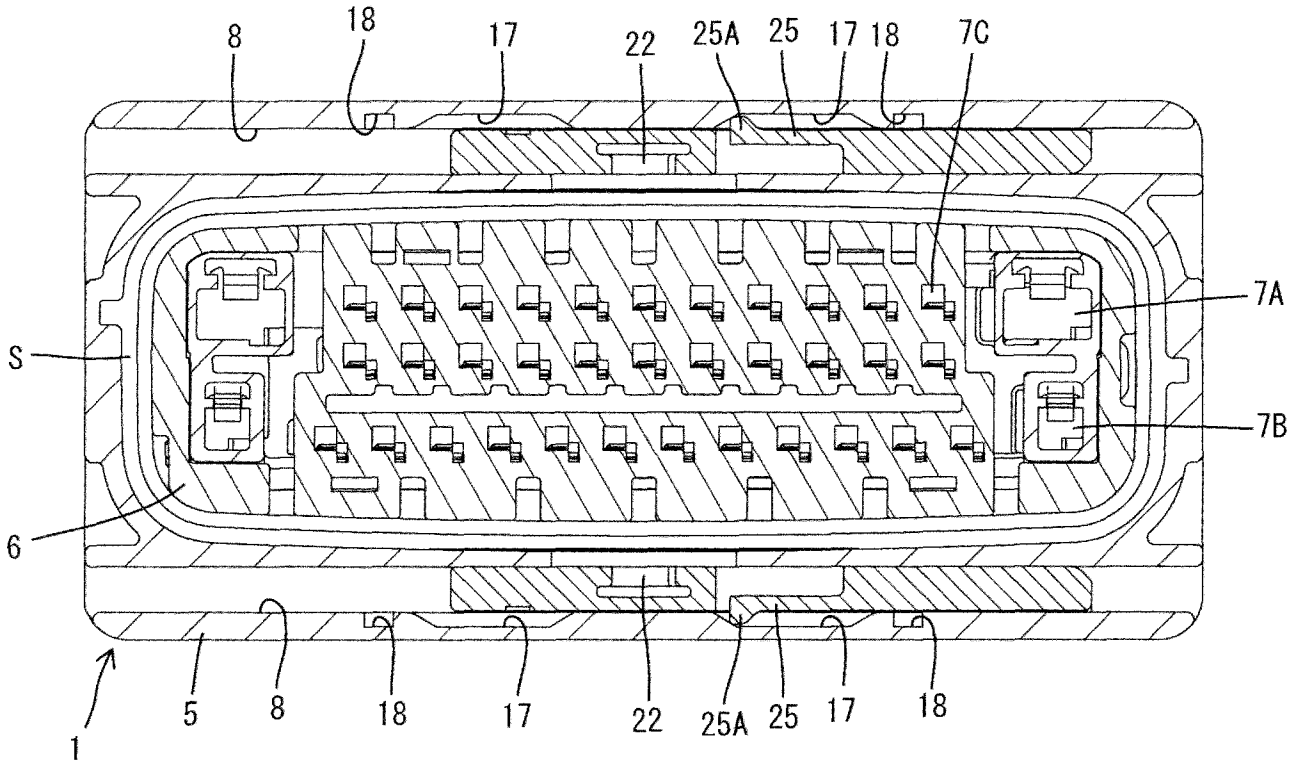
FIG. 12 is a front view in section showing a state where the sliders are at a second position.

The slider accommodating chambers 8 are open at the opposite end parts of the longer sides and the sliders 2 can be inserted through both openings. As shown in FIGS. 11 and 12, two first locking recesses 17 are formed bilaterally symmetrically in a central part of a lower area of the inner surface of each outer wall forming the slider accommodating chamber 8 in a length direction. Further, moderately inclined surfaces are formed on opposite ends of each of the first locking recesses 17 in the length direction, and a part between the moderately inclined surfaces is a straight surface extending in the length direction.

Two second locking recesses 18 are formed at opposite sides of the first locking recesses 17 in the length direction. The second locking recesses 18 are arranged at the same height as the first locking recesses 17 and are arranged bilaterally symmetrically in the slider accommodating chamber 8, similarly to the first locking recesses 17. The second locking recesses 18 are shorter than the first locking recesses 17 and rising surfaces on opposite end parts in the length direction are substantially perpendicular to a direction perpendicular to the connecting direction.

As shown in FIG. 4, the inner surfaces of the outer walls forming the slider accommodating chambers 8 are recessed along a direction substantially perpendicular to the connecting direction at positions near end parts substantially facing the cover 3 to form guiding grooves 20. The guiding grooves 20 guide sliding movements of the sliders 2.

Spaced apart stopper walls 19 project up on opposite left and right ends of the upper surface of the housing 1, as shown in FIG. 4. The stopper walls 19 contact the inner surface of a shorter side of the cover 3 to prevent a movement of the cover 3 rightward in FIG. 3 when the cover 3 is mounted in a proper aligned state on the housing 1.

Figure 6:
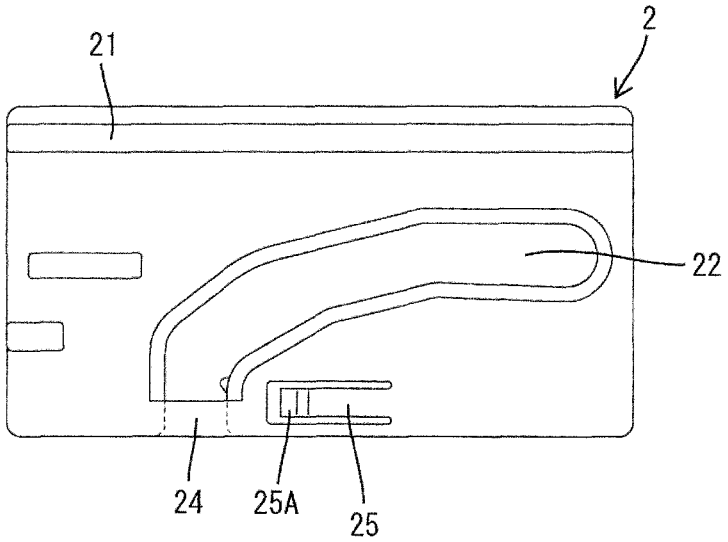
FIG. 6 is a side view of a slider.

The sliders 2 are plates made e.g. of synthetic resin. The sliders 2 are accommodated in the slider accommodating chambers 8 in a state where an outer surface (side shown in FIG. 6) is facing the inner surface of the outer wall forming the slider accommodating chamber 8. As shown in FIG. 6, a sliding edge 21 projects on an upper part of the outer surface of the slider 2 and defines a rib extending in a longitudinal direction substantially perpendicular to the connecting direction. The sliding edge 21 fits into the guiding groove 20 of the slider accommodating chamber 8 and guides a movement of the slider 2, as shown in FIG. 4. A cam groove 22 of a specified shape penetrates through the slider 2. One end side of the cam groove 22 is open at a position of the lower edge of the slider 2 near one longitudinal end and can receive a cam pin 23 projecting from the outer surface of the mating connector to display a cam action. An opening end of the cam groove 22 is connected to a bridging piece 24 to prevent an opening deformation. The cam groove 22 extends obliquely up toward the other longitudinal end of the slider 2 after extending up from the opening end.

A locking claw 25 is extends horizontally in a longitudinal central part of the lower edge of the slider 2. As shown in FIGS. 11 and 12, an inner side of the locking claw 25 is thinned. This makes the locking claw 25 resiliently deformable toward a thinned side. Further, a claw portion 25A is formed on a tip part of the locking claw 25 and projects toward the inner surface of the outer wall of the slider accommodating chamber 8. A tip surface of the claw portion 25A rises perpendicular to a moving direction of the slider 2, but an opposite surface is inclined.

Thus, when the slider 2 is at the first position shown in FIG. 11, the tip surface of the claw portion 25A is in substantially surface contact with the left end of the second locking recess 18 on the left side in FIG. 11 to prevent the slider 2 from being detached leftward from the slider accommodating chamber 8. However, the opposite surface of the claw portion 25A is inclined. Thus, a movement of the slider 2 to the right is only loosely restricted and a locked state is released if a specified force is applied and the claw portion 25A can come out of the second locking recess 18. When the slider 2 is at the second position shown in FIG. 12, the claw portion 25A has moved to the first locking recess 17 on the opposite right side and engages the inclined surface on the left end of the first locking recess 17. This only loosely restricts a return of the slider 2 from the second position to the first position and the claw portion 25A can be released from the locked state and relatively easily come out of the first locking recess 17 when receiving a predetermined force.

Figure 7:
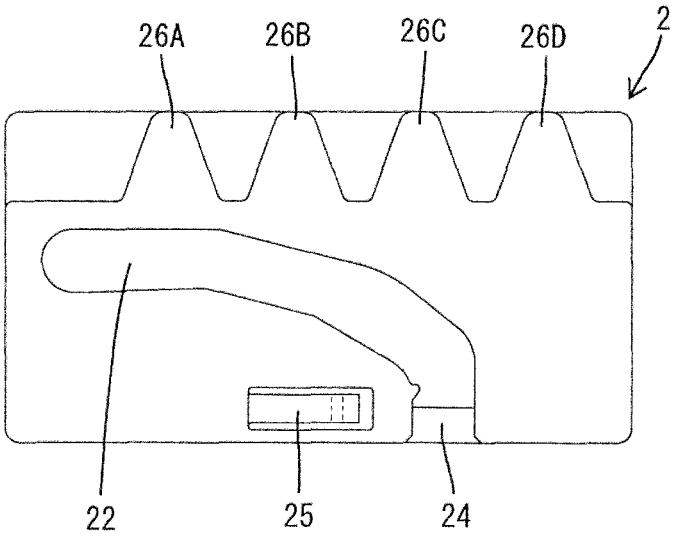
FIG. 7 is a side view of the slider shown in FIG. 6 when viewed from an opposite side.
Figure 14:
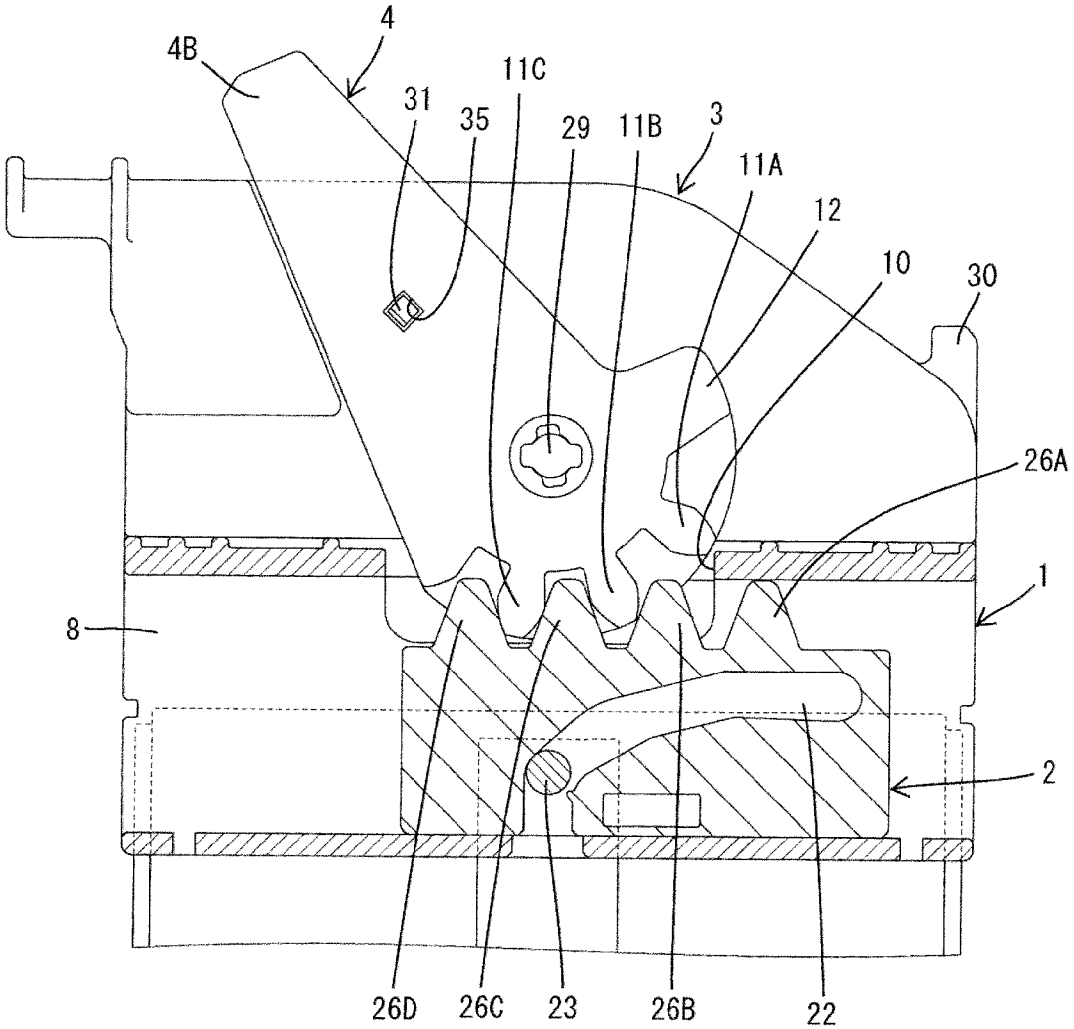
FIG. 14 is a side view in section showing a state where the connectors are lightly fitted in the connector connecting procedure.
Figure 16:
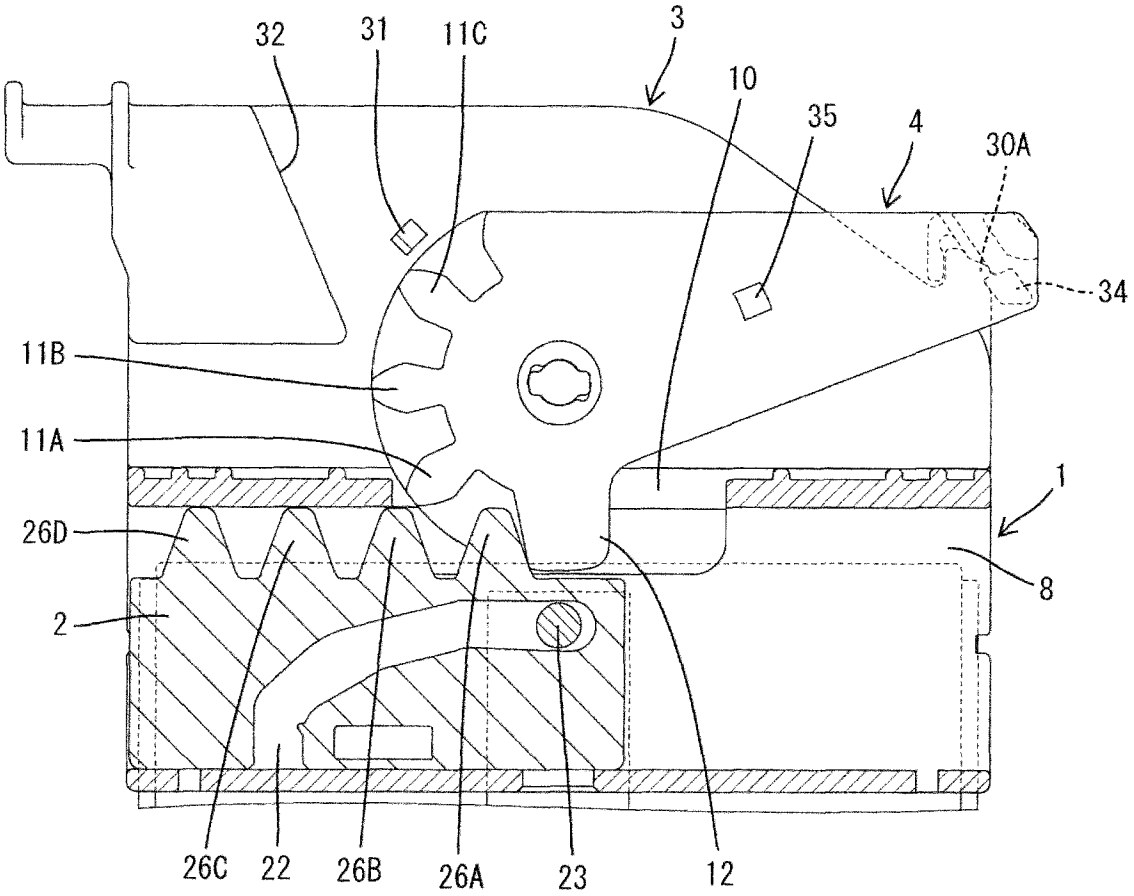
FIG. 16 is a side view in section showing a state where the connecting operation is completed in the connector connecting procedure.

As shown in FIG. 7, rack teeth 26A to 26D are formed at substantially constant pitches on an upper edge of the inner surface of the slider 2 by thinning this upper edge part from the inner side. As shown in FIGS. 11 and 16, when the slider 2 is at the first position, the left end of the slider 2 is substantially flush with the left opening end surface of the slider accommodating chamber 8 and does not project from the housing 1. As shown in FIG. 16, when the slider 2 is at the first position, the leading rack tooth 26A and a part of the second rack tooth 26B face the cut 10. On the other hand, as shown in FIGS. 12 and 14, when the slider 2 is at the second position, the right end of the slider 2 is retracted slightly from the right opening end surface of the slider accommodating chamber 8. As shown in FIG. 13, three rack teeth 26B to 26D excluding the leading rack tooth 26A face the cut 10 when the slider 2 is at the second position.

The cover 3 at least partly covers the housing 1 from above and is open on a surface facing the housing 1 and a left surface. The cover 3 accommodates wires drawn out from the upper) draw-out surface of the housing 1 inside. As described above, the cover 3 can be mounted on the housing 1 either in one lateral-facing posture or in an opposite lateral-facing posture so that the cover 3 can modify a wiring direction of the wires W according to a mounting direction thereof.

As shown in FIGS. 4 and 8, the guides 15 are provided along a longitudinal direction on lower edge parts of opposite longer side surfaces of the cover 3. As shown in FIG. 4, outwardly open sliding grooves 27 are formed on outer sides of the guides 15 and are of substantially C-shaped cross-section. The guide receiving portions 9 of the housing 1 fit into the sliding grooves 27 so that the sliding grooves 27 can move along the guide receiving portions 9. That is, the guides 15 can move and guide the cover 3 in the direction substantially perpendicular to the connecting direction in a state where the guide receiving portions 9 are sandwiched vertically in the sliding grooves 27.

As shown in FIG. 8, the mounting piece 16 extends substantially horizontally at a position near the left end in a central part of the sliding groove 27. The mounting piece 16 is cantilevered along the lateral direction and is deflectable in a thickness direction (depth direction of the plane of FIG. 8). The mounting piece 16 prevents a movement of the cover 3 to the right by engaging the opening edge of one escaping portion 13 and the projecting edge 14 when the cover 3 changes from the unaligned state in FIG. 9 to the aligned state in FIG. 10 with respect to the housing 1.

Figure 9:
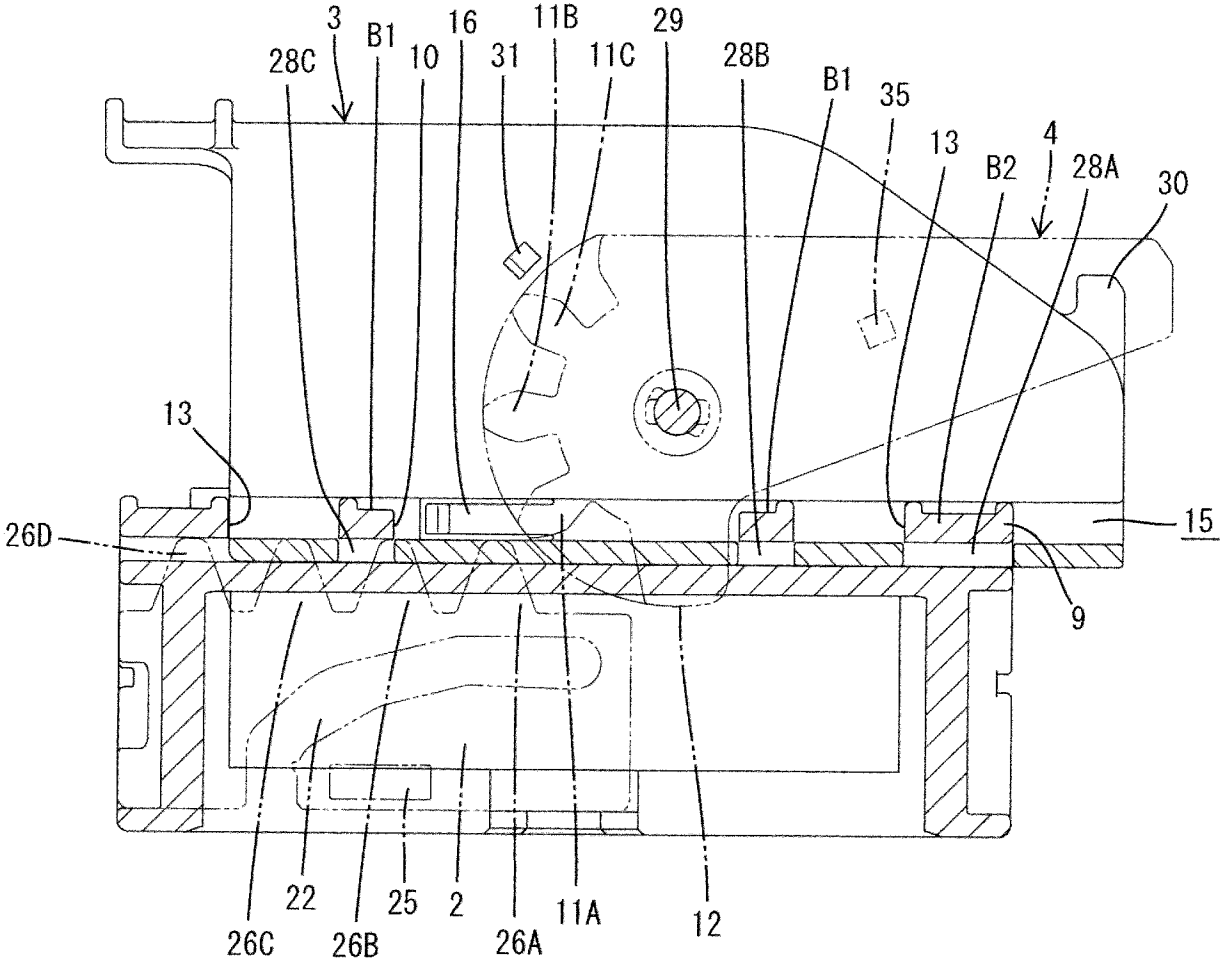
FIG. 9 is a side view in section showing a state where the cover is at a non-engageable position in the cover mounting procedure.

As shown in FIG. 8, the lower surface of the guide 15 is cut to form interference avoiding portions 28A to 28C to enable the cover 3 to be mounted on the housing 1 in the unaligned state. The interference avoiding portions 28B, 28C are through holes and have lengths so that parts B1 between the cut 10 and the escaping portions 13 in the guide receiving portion 9 can fit therein, and the interference avoiding portion 28A is a through hole with a length so that both left and right ends B2 of the guide receiving portion 9 can fit therein. Accordingly, as shown in FIG. 9, the cover 3 can be mounted on the housing 1 in the unaligned state (see FIG. 9) by fitting the corresponding interference avoiding portions and parts to each other in the process of mounting the cover 3 onto the housing 1. Note that the position of the cover 3 in this unaligned state is a position where the gears of the lever 4 and the racks of the sliders 2 are not engaged. Hereinafter, the position of the cover 3 at this time is referred to as a non-engageable position.

As shown in FIG. 8, two support shafts 29 project unitarily from the opposite longer side surfaces of the cover 3 and are used to mount the lever 4. The right side of the upper surface of the cover 3 is inclined moderately down to avoid interference when the lever 4 is at a standby position, and a lever lock 30 for locking the lever 4 at the standby position projects on a lower part of the moderately inclined surface. A lock claw 30A projects unitarily from a shown right surface of this lever lock 30, as shown in FIG. 3.

Figure 15:
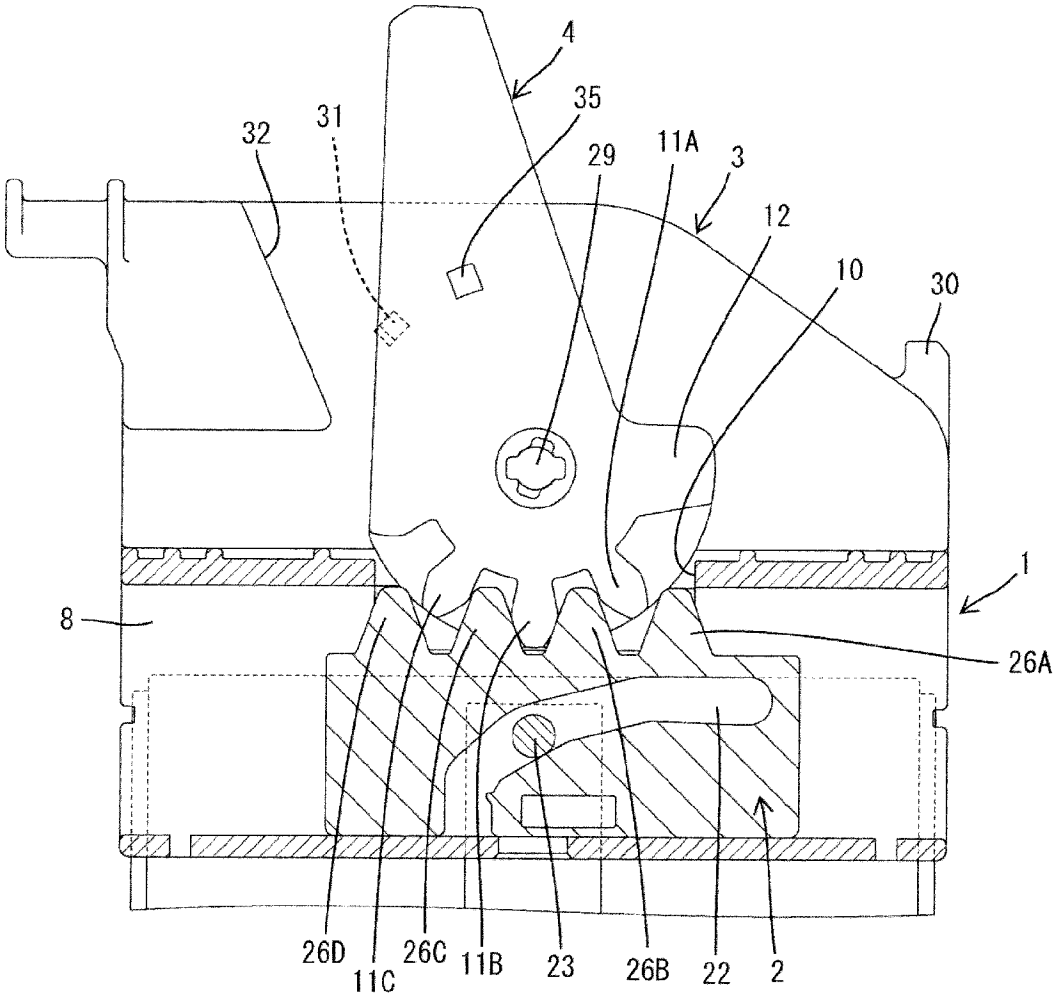
FIG. 15 is a side view in section showing an intermediate state of a connecting operation after the lever is operated in the connector connecting procedure.

Locking projections 31 project at positions of the opposite longer side surfaces of the cover 3 at a side substantially opposite to the lever lock 30 for holding the lever 4 at the initial position shown in FIGS. 13 and 14. Further, as shown in FIG. 15, contact edges 32 are formed at substantially the same position on the outer surfaces of the cover 3 and contact respective lateral edges of the lever 4.

Figure 1:
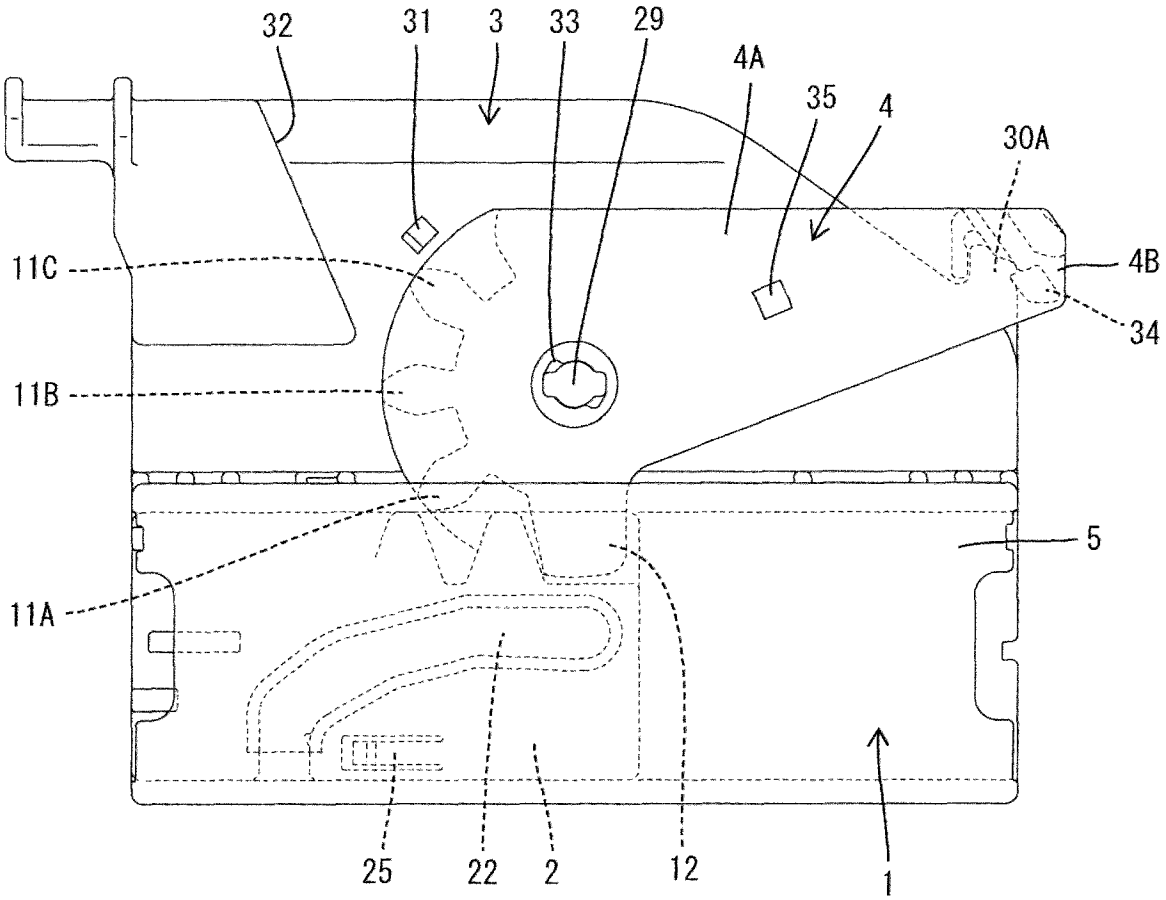
FIG. 1 is a side view of a lever-type connector when a lever is at a standby position (connection completion position).

As shown in FIG. 1, the lever 4 has two side plates 4A and an operating portion 4B couples the side plates 4A. Mounting holes 33 penetrate central parts of the side plates 4A and can be fit to the support shafts 29 so that the lever 4 is rotatable about the support shafts 29. The lever 4 is rotatable between a position where the lever 4 is held when connection to the mating connector is started (initial position) as shown in FIG. 13 and a position where the lever 4 is held when the connection to the mating connector is completed, as shown in FIG. 1.

A resiliently deformable locking claw 34 is formed in a widthwise center of the operating portion 4B and is engageable with the lock claw 30A of the lever lock 30 when the lever 4 is at the standby position. Further, windows 35 are formed at positions of the side plates 4A of the lever 4 near the operating portion 4B, and the lever 4 can be held loosely at the initial position by releasably locking the locking projections 31 of the cover 3 by the windows 35.

The outer edge of each side plate 4A of the lever 4 is formed into an arc centered on a center of rotation of the lever 4. First to third gear teeth 11A to 11C are formed at substantially uniform pitches by thinning a peripheral edge part of each side plate 4A from the outer side. The stopper tooth 12 is formed at a position on substantially the same circumference as the gear teeth 11A to 11C and adjacent to the first gear 11A. As shown in FIG. 16, this stopper tooth 12 contacts the leading rack tooth 26A of the slider 2 when the lever 4 is at the standby position, thereby preventing inadvertent movement of the slider 2 from the first position to the second position (shown in FIGS. 13 and 14).

A pitch between the stopper tooth 12 and the first gear 11A is larger than pitches between the gear teeth 11A to 11C. In mounting the cover 3 on the housing 1, the cover 3 is held temporarily at the non-engageable position with respect to the housing 1 while the lever 4 is held at the standby position. At this time, as shown in FIG. 9, the tips of the first gear teeth 11A closest to the housing 1 are at positions proximate to the leading rack teeth 26A, but are above the tips of the leading rack teeth 26A.

Figure 10:
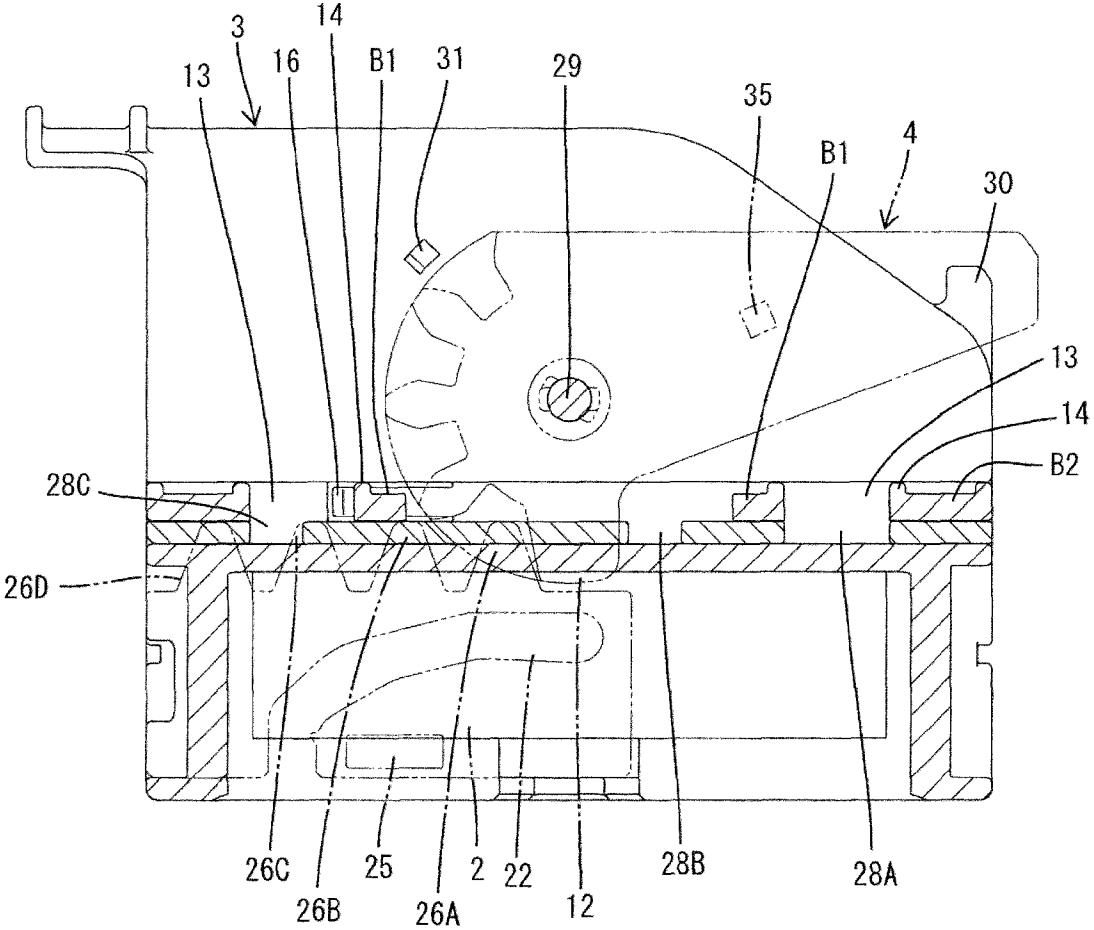
FIG. 10 is a side view in section showing a state where the cover is at an engageable position in the cover mounting procedure.

The cover 3 is moved from the non-engageable position to the left side along the direction substantially perpendicular to the connecting direction as shown in FIG. 10, thereby being finally mounted. The pitch between the first gear teeth 11A and the stopper teeth 12 is set so that the left surfaces of the stopper teeth 12 contact the right surfaces of the leading rack teeth 26A and the first gear teeth 11A are above and between the leading rack teeth 26A and the second rack teeth 26B adjacent to the leading rack teeth 26A and closer to the second rack teeth 26B when the cover 3 reaches a final mount position (hereinafter, referred to as an engageable position). The engagement of the respective gear teeth 11A to 11C and the rack teeth 26A to 26D can be started when the lever 4 is rotated toward the initial position.

An operation of mounting the cover 3 in a state where the lever 4 is mounted is described (see FIGS. 8 to 10). First, the lever 4 is moved toward the standby position and the resilient locking claw 34 is engaged with the lock claw 30A of the lever lock 30 of the cover 3 to hold the lever 4 at the standby position. In this state, as shown in FIG. 8, the entire cover 3 faces the upper surface of the housing 1 at a right position. Thereafter, the entire cover 3 is brought closer to the housing 1 substantially along the connecting direction. Then, the parts B1 are fit between the cut 10 and the escaping portions 13 in each guide receiving portion 9 and the right end part B2 of the guide receiving portions 9 are aligned with and pushed into the corresponding interference avoiding portions as shown in FIG. 9. The cover 3 is fit at the position to be in the unaligned state with respect to the housing 1, i.e. at the non-engageable position. At this time, the tips of the first gear teeth 11A of the lever 4 are above the rack teeth 26A to 26D and the stopper teeth 12 are spaced apart in a rightward direction of FIG. 9 from the leading rack teeth 26A.

The cover 3 then is moved to the left and substantially perpendicular to the connecting direction with respect to the housing 1. At this time, the guide receiving portions 9 of the housing 1 fit into the sliding grooves 27 of the cover 3 to guide a movement. During this time, the mounting pieces 16 slide in contact with the inner side surfaces of the guide receiving portions 9 while being deflected inward. When the cover 3 reaches the position to be aligned with the housing 1, i.e. the engageable position, the mounting pieces 16 resiliently return to engage the opening edges of the left escaping portions 13, thereby preventing a movement of the cover 3 in a return direction, as shown in FIGS. 10 and 11. Simultaneously, the inner surface of the shorter side of the cover 3 opposite to the side where the wires W are drawn out contact the stopper walls 19 on the right end of the housing 1 to prevent movement of the cover 3 to the left beyond the engageable position.

As just described, the cover 3 is mounted on the housing 1 by being moved in two directions, i.e. first the connecting direction and then substantially perpendicular to the connecting direction. Specifically, in bringing the cover 3 into contact with the housing 1 along the connecting direction, the respective gears of the lever 4 and the racks of the slider 2 do not come into contact since the cover 3 and the housing 1 are not aligned. Further, when the lever 4 is at the standby position, the tips of the first gear teeth of the gears are located above the leading rack teeth of the racks and the pitch between the first gear teeth and the stopper teeth 12 is relatively large. Thus, a situation where the gears and the racks are engageable with each other while the interference thereof is avoided can be realized also while the cover 3 is moved from the non-engageable position to the engageable position.

Further, in a state where the cover 3 is mounted properly on the housing 1 at the engageable position, upward detachment of the cover 3 is prevented by the engagement of the sliding grooves 27 of the guides 15 of the cover 3 and the guide receiving portions 9. Since a structure of this embodiment for retaining the cover 3 is a retaining structure unaccompanied by resilient deformation, i.e. a supporting structure realized by vertically sandwiching the guide receiving portions 9 by the sliding grooves 27 unlike the conventional retaining structure utilizing resilient forces. Thus, upward detachment of the cover 3 is prevented.

To start connection, the lever 4 is moved from the standby position (FIG. 16) to the initial position (FIG. 13). Thus, a somewhat strong force is applied in the counterclockwise direction to the operating portion 4B of the lever 4 at the standby position. As a result, the resilient locking claw 34 of the lever 4 and the lock claw 30A of the lever lock 30 of the cover 3 forcibly disengage so that the lever 4 can be rotated in the counterclockwise direction. Associated with this, the first gear teeth 11A of the lever 4 start to engage the rack teeth 26A to 26D of the sliders 2. Specifically, the first gear teeth 11A of the lever 4 push the side surfaces of the leading rack teeth 26A. At this time, as shown in FIG. 11, the locking claws 25 of the sliders 2 fit in the shown left second locking recesses 18, but the locking claws 25 come out of the second locking recesses 18 upon the action of the force since the claw portions 25A of the locking claws 25 have the inclined surfaces. Thereafter, the respective gears of the lever 4 and the racks engage as the lever 4 is rotated, with the result that the sliders 2 move to the second position and the lever 4 moves to the initial position, as shown in FIG. 13. At these positions, the locking projections 31 fit into the windows 35 to hold the lever 4 loosely at the initial position. Further, during this time, the locking claws 25 of the sliders 2 temporarily resiliently return to fit into the shown left first locking recesses 17, as shown in FIG. 12. After passing these left first locking recesses 17, the locking claws 25 reach the shown right first locking recesses 17, resiliently return and are kept loosely engaged with the shown left end parts of the right first locking recesses 17.

The entrances of the cam grooves 22 are in a longitudinal center of the housing 1 when the lever 4 is at the initial position and the sliders 2 are at the second position, as shown in FIG. 13. The mating connector then is fit lightly into the connection space of the housing 1, and the cam pins 23 enter the cam grooves 22, as shown in FIG. 14. Thereafter, the lever 4 is rotated clockwise by operating the operating portion 4B, and the sliders 2 are displaced toward the first position via the engagement of the gear teeth 11A to 11C of the lever 4 and the rack teeth 26A to 26D of the sliders 2. The cam pins 23 move to the back sides in the cam grooves 22 as the connecting operation proceeds (FIG. 15). When the lever 4 reaches the standby position, as shown in FIG. 16, the sliders 21 reach the first position, with the result that the cam pins 23 reach the back ends of the cam grooves 22 and the connectors are connected completely.

As described above, the connector is designed so that the cover 3 is mounted by first moving the cover 3 along the connecting direction and fitted at a position where the cover 3 is not aligned with the connector housing 1. Thus, at this point of time, the interference of the respective gears of the lever 4 and the racks of the sliders 2 is avoided. The cover 3 then is moved in the direction intersecting the connecting direction and the mounting is completed in a state where the gear teeth 11A to 11C and the rack teeth 26A to 26D are engageable. In the mounted state of the cover 3, the guide receiving portions 9 are held by being vertically sandwiched in the sliding grooves 27 of the guides 15 instead of being held by resilient locking pieces as before. Thus, a large holding force resisting upward detachment of the cover 3 can be obtained.

Further, the lever 4 is at the standby position, for example, while the connector is being transported to a site of the connecting operation. In this state, the lever 4 is in a compact state without projecting far from the connector as at the initial position. This is effective in such a case where the connector is forced to be connected after being inserted into a small hole. Further, when the lever 4 is at the standby position, the sliders 2 are at the first position and entirely accommodated in the slider accommodating chambers 8 and do not project out from the housing 1. Accordingly, the sliders 2 are not inadvertently moved to the second position upon receiving an external force. Even if an external force is received, the stopper teeth 12 of the lever 4 in a locked state and the leading rack teeth are substantially in surface contact. Thus, movements of the sliders 2 are prevented reliably.

Temporary holding structures are provided for holding the lever 4 at the initial position and the sliders 2 at the first position when the cam pins 22 of the mating connector are received into the cam grooves 22. Thus, the locking projections 31 of the cover 3 loosely engage the windows 35 of the lever 4 and the locking claws 25 of the sliders 2 engage the inclined surfaces on the end parts of the first locking recesses 17 of the housing 1 for the sliders 2. By these temporarily holding means, the cam grooves 22 are positioned to reliably receive the cam pins 23 so that the connectors can be connected smoothly. These temporary holding means can be released relatively easily by somewhat strongly operating the lever 4, so that operability is not affected at all.

The locking claws 35 that are the temporary holding means for the sliders 2 are also used for reliably restricting detachment of the sliders 2 at the first position to the outside of the housing 1 by changing their engaged positions to engaged positions with the second locking recesses. This can also contribute to simplifying the configuration.

Furthermore, the standby position of the lever 4 is the connection completion position where the connecting operation of the connectors is completed. Thus, a rotatable range of the lever 4 is defined between the initial position and the connection completion position. If the standby position and the connection completion position are set at different positions, the rotatable range of the lever 4 is the sum of a range between the initial position and connection completion position necessary for the connector connecting operation and a rotatable range to the standby position. This leads to problems such as the enlargement of the connector associated with the securement of a peripheral area of the operating portion 4B of the lever 4 and an increase in the engagement stroke of the gears and the racks. However, such problems are avoided in this embodiment.

Furthermore, this embodiment particularly also has effects of being able to switch the mounting direction of the cover 3 and the mounting direction of the sliders 2 to either the leftward or rightward direction and select the wiring direction of the wires W and the like as needed.

The invention is not limited to the above described and illustrated embodiment. For example, the following embodiments also are included in the scope of the invention.

In the above embodiment, a sliding movement of the cover 3 is guided by fitting the guide receiving portions 9 provided on the connector housing 1 into the sliding grooves 27 of the guide portions 15 provided on the cover 3. Contrary to this, the guide portions 15 may be provided on the connector housing 1 and the guide receiving portions 9 may be provided on the cover 3.

Although the temporary holding means (locking projections 31 and windows 35) for holding the lever 4 at the initial position and that (locking claws 25 and first locking recesses 17) for holding the sliders 2 at the first position are separately provided in the above embodiment, only either one of them may be provided.

Although two separate sliders 2 are used in the above embodiment, the both sliders 2 may be coupled at end parts and used as one member.

Although the mounting directions of the cover 3 and the sliders 2 onto the housing 1 can be selected in the above embodiment, each mounting direction may be fixedly set at only one direction.

Although the temporary holding means for the lever 4 and the sliders 2 are released by applying a somewhat strong force to the operating portion 4B of the lever 4 in this embodiment, they may be, instead, automatically released as the connectors are connected.

What is claimed is:

1. A lever-type connector for connecting connectors by rotating a lever, comprising:

a housing formed with a cavity for accommodating a terminal fitting and connectable to a mating connector;

a cover to be mounted on a surface of the housing substantially opposite to a connection surface and configured to at least partly cover a wire drawn out from the housing;

a lever rotatably mounted on the cover and formed with gear teeth on an edge around a center of rotation of the lever; and a slider accommodated in the housing displaceably in a direction intersecting a connecting direction and formed with rack teeth engageable with the gear teeth at a position facing the lever and a cam groove for guiding a cam pin on the mating connector to bring the connectors into a connected state; wherein:

the cover includes a guide and the housing includes the guide receiving portion, the guide and the guide receiving portion substantially extending in the direction intersecting with the connecting direction, the guide and the guide receiving portion are formed to be engaged with each other after the cover is mounted in a direction along the connecting direction to a non-engageable position where the cover is not aligned with the housing and the gear teeth and the rack teeth are not engaged and able to guide a movement of the cover along the direction intersecting with the connecting direction to an engageable position where the cover aligns with the housing and the gear teeth and the rack teeth are engageable; and the guide is undeflectably formed on the cover, the guide receiving portion is undeflectably formed on the housing, and the guide and the guide receiving portion include parts that contact each other in the connecting direction, thereby preventing the cover from being detached in the connecting direction.

2. The lever-type connector of claim 1, wherein the lever is held at a standby position where the gear teeth are located at such a height position as not to interfere with the rack teeth and the slider is held at a first position spaced apart forward from the cover in a moving direction of the cover in a slider accommodating chamber formed in the housing when the cover moves from the non-engageable position to the engageable position.

3. The lever-type connector of claim 1, wherein the lever is rotatable between the standby position which is one engagement stroke end of the gear teeth and the rack teeth and an initial position which is the other engagement stroke end and the slider is movable between the first position and a second position as the gear teeth and the rack teeth are engaged.

4. The lever-type connector of claim 1, wherein the cam groove of the slider is capable of receiving the cam pin formed on the mating connector when the slider is at the second position.

5. The lever-type connector of claim 1, wherein a temporary holding means for releasably temporarily holding the slider at the second position is provided at least between the slider and the housing or between the lever and the cover.

6. The lever-type connector of claim 1, wherein the lever is formed with a stopper tooth for preventing the slider from moving in a direction opposite to the moving direction of the cover by contacting a leading rack tooth substantially facing in the moving direction of the cover at the first position in a state where the cover is at the engageable position and the lever is at the standby position.

7. The lever-type connector of claim 6, wherein the stopper tooth is at an end part in an arrangement direction of the gear teeth and a pitch between the stopper tooth and the gear teeth adjacent to the stopper tooth is larger than a pitch between the other gear teeth.

8. The lever-type connector of claim 7, wherein the slider is accommodated so as not to project out from the slider accommodating chamber at the first position.

* * * * *